United States Patent [19]

Braswell

[11] Patent Number: 4,492,561

[45] Date of Patent: Jan. 8, 1985

[54] WELDERS TORCH IGNITING DEVICE

[76] Inventor: Richard R. Braswell, 3154 Studebaker Rd., Long Beach, Calif. 90808

[21] Appl. No.: 451,285

[22] Filed: Dec. 20, 1982

[51] Int. Cl.[3] ..... F23Q 7/10

[52] U.S. Cl. ..... 431/128; 431/263; 200/52 R; 200/153 T; 200/161

[58] Field of Search ..... 431/128, 263; 362/802; 200/153 T, 161, 61.03, 61.86; 361/155, 156

[56] References Cited

U.S. PATENT DOCUMENTS

| | | | |
|---|---|---|---|
| 1,915,446 | 6/1933 | Pressler | 431/128 |
| 3,932,718 | 1/1976 | Porat | 200/61.93 |
| 4,108,592 | 8/1978 | Fair | 431/128 |
| 4,113,423 | 9/1978 | Steiner | 431/128 |
| 4,133,111 | 1/1979 | Logan | 33/1 M |

*Primary Examiner*—Samuel Scott
*Assistant Examiner*—Allen J. Flanigan
*Attorney, Agent, or Firm*—William C. Babcock

[57] ABSTRACT

A device for automatically igniting the oxygen-acetylene mixture flowing from a welders torch when the tip of the torch is brought into pressure contact with an elongate resilient member that forms a part of the invention.

1 Claim, 7 Drawing Figures

2
28
29
24
32a
2
48
48a
A
42b
46
42a
50
S
44
42
32
D
30
64
62
C
14
10
12
16
B
10
12
4

S
52
54
26
48
48a
29
34
24
24
34b
50
29
28
44
42
42a
3
3
42b
62
46b
46a
46c 24
24
29
34b
24b
24b
24a
34a
20
24a
34
48
F
74
E
32
18
70
32
72
82
82
80
4

28
29
29
26
42
37
34
35
44
18
40
41
30
E
64
60
66
62
63
54
37
52
35

50
50a
46c
46a
46
46b
42a
42c

26
D-2
28
24a
24
24b
24a
20
32
20b
20a
18
32a
D-1
30a
32
30
22b
22a
22
D-3
30b

S
54
56
58
62
52
60
60a
F
62a
63
68
64
66
G
E
36a
38a
74
34
70
38
36
34a
34b
36b
38b
76
72
G
G
G

WELDERS TORCH IGNITING DEVICE

BACKGROUND OF THE INVENTION

In the past, it has been common practice for a welder to ignite the oxygen-acetylene mixture discharging from his torch by using a cigarette lighter, matches, or the like for this purpose, all of which are inconvenient, and time consuming.

A major object of the present invention is to provide a device that eliminates the necessity of using matches, cigarette lighters or the like for igniting a welders torch.

A further object of the invention is to supply a welders torch igniting device that has a simple mechanical structure, is convenient and easy to use, can be fabricated from standard commercially available materials, and is automatically actuated when the welder moves the tip of the torch transversely in any direction into pressure contact with an elongate resilient member that is supported at a convenient location from a housing of substantial size that extends upwardly from a base, all of which form a part of the invention.

These and other objects and advantages of the invention will become apparent from the following description of a preferred form thereof as hereinafter described in detail.

SUMMARY OF THE INVENTION

The welders torch igniting device of the present invention includes a housing of substantial height that extends upwardly from a base, with the housing having an upper apertured end portion. The housing defines a confined space in which a high tension coil, electrical switch, and spark plug are disposed, with the latter being located adjacent the upper apertured end portion.

A bracket extends forwardly from the housing and supports a tensioned elongate helical spring. A first end portion of the helical spring is straight and is pivotally supported from the bracket. A cord extends rearwardly from the first end portion of the spring to an actuating member that forms a part of the electrical switch, which switch is normally in an open position. Upon the helical spring being pressure contacted by the tip of a welding torch, the first end portion of the spring pivots to momentarily tension the cord and move the actuating member to a position to close the switch. The actuating member is spring loaded and automatically returns to a position where the switch is open, upon the helical spring being relieved of pressure contact.

An electrical circuit is completed to the high tension coil to generate a spark in the spark plug when the actuating member of the switch places the latter in the closed position, with the spark igniting the oxygen-acetylene mixture flowing from the torch towards the aperture upper end portion of the housing. The circuit to the spark plug and high tension coil is automatically terminated when the tip of the welders torch is removed from pressure contact with the tensioned elongate helical spring.

DESCRIPTION OF THE PREFERRED EMBODIMENT

Figure 1:
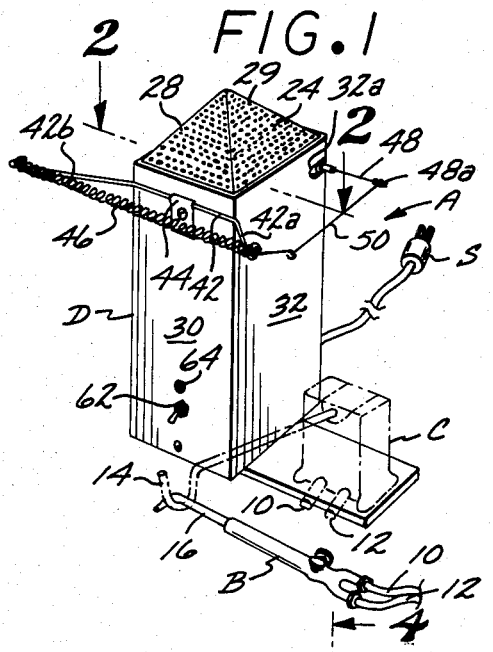
FIG. 1 is a perspective view of the welders torch igniting device.
Figure 2:
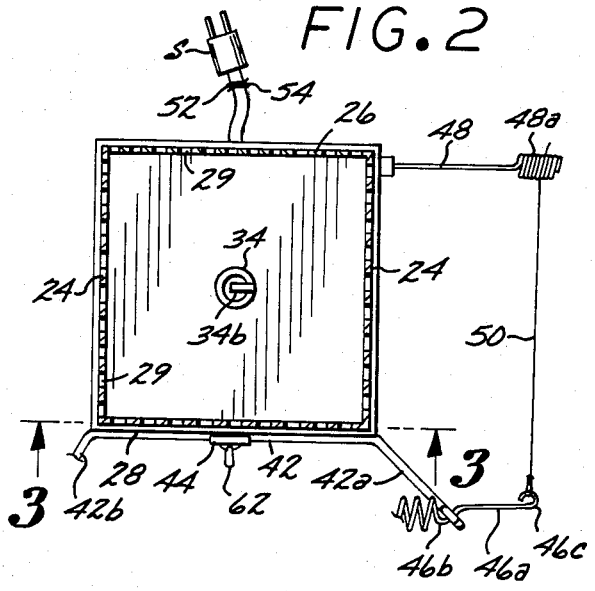
FIG. 2 is a top plan view of the device taken on the line 2—2 of FIG. 1.

The welders torch igniting device A is shown in perspective in FIG. 1, together with a conventional welding torch B that is supplied oxygen and acetylene through conduits 10 and 12 that extend to a conventional valve assembly C. The valve assembly C has a spring loaded actuating member 14 that tends at all times to pivot to a position where oxygen and acetylene may flow to the conduits 10 and 12, but is maintained in a position where the valve is closed when the tip 16 of the welders torch B rests on a hook portion of the member 14.

The invention A includes a housing D that is defined by first, second and third portions D-1, D-2 and D-3. These three components are shown in detail in FIG. 5. The first housing portion D-1 as may be seen in FIG. 5 includes a vertical rectangular back wall 18 that has an upper horizontal leg 20 projecting forwardly therefrom and a lower leg 22 of substantially the same size as the leg 20 that projects forwardly from the lower edge of back wall 18.

The upper leg 20 has an extension **20*a* of lesser width that projects downwardly therefrom, which extension has a transverse opening 20*b* formed therein. The lower leg 22 has an extension 22*a* that projects upwardly therefrom and is in vertical alignment with the extension 20*a*. The extension 22*a* has a transverse opening 22*b*** therein.

Figure 5:
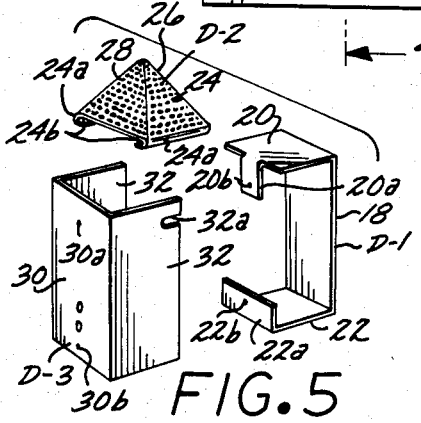
FIG. 5 is a perspective view of the components that cooperate to define the housing.

The second housing portion D-2 is preferably of piramid shape and is defined by two triangular shaped side pieces 24, and similar rearward and forward side pieces 26 and 28 that have the edges thereof in abutting contact and extend upwardly and inwardly towards one another as shown in FIG. 5. The pair of triangular shape side pieces 24 have downwardly projecting extensions **24*a* that curve inwardly towards one another, with the extensions 24*a* cooperating to provide a pair of rearwardly extending grooves 24*b* that may slidably engage the side edges of the upper leg 20 as may best be seen in FIG. 3**.

The third portion D-3 of the housing as shown in FIG. 5 includes a forward vertically disposed rectangular wall 30 that has a pair of vertical rectangular side walls extending rearwardly therefrom, with the forward wall having spaced openings **30*a* and 30*b* formed therein. One of the side walls 32 has a slot 32*a*** formed in the upper rearward portion thereof.

Figure 3:
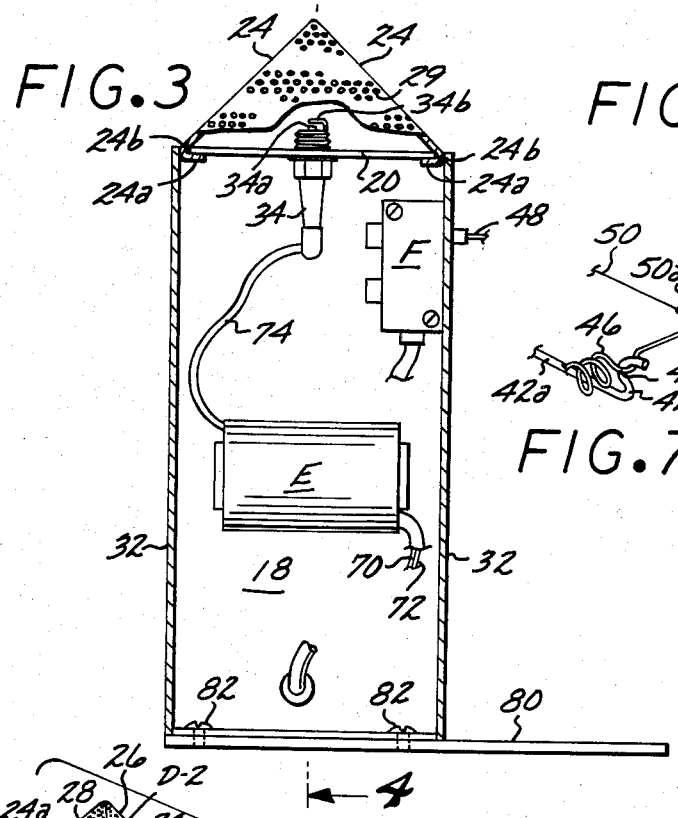
FIG. 3 is a vertical cross sectional view of the device taken on the line 3—3 of FIG. 2.
Figure 4:
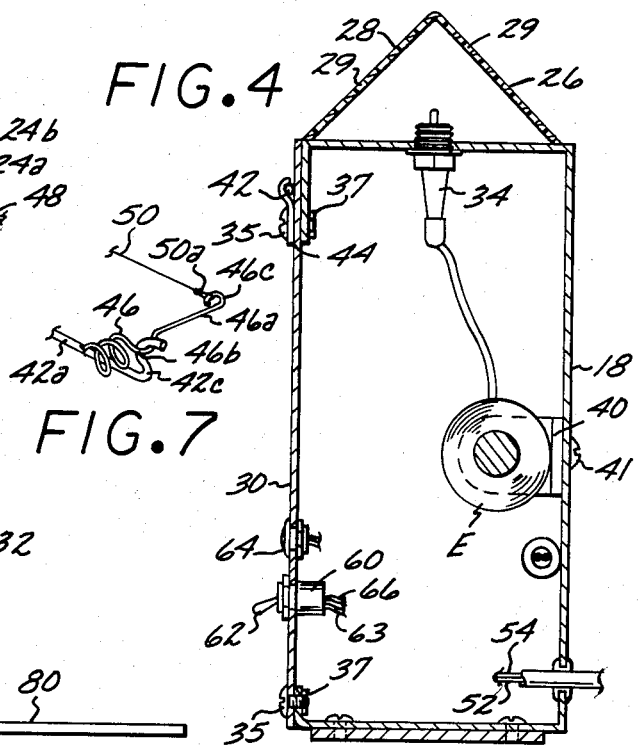
FIG. 4 is a second vertical cross sectional view of the device taken on the line 4—4 of FIG. 3.

In FIGS. 3 and 4 it will be seen that a conventional spark plug 34 is provided that has points **34*a* and 34*b*. Spark plug 34 is held in an inverted position in an opening that extends through the upper leg 20. When the grooves 24*b* of the second housing portion D-2 are caused to engage opposite side edges of the upper leg 20, and the second housing portion is moved rearwardly thereto, the points of the spark plug are situated within a confined space defined by the leg 20** and second housing portion D-2.

The first and second housing portions D-1 and D-2 when so assembled are moved within the confines of the third housing portion D-3 to provide the assembly shown in FIG. 1. The housing portion D-1, D-2 and D-3 are removably held together by screws 35 that extend through pairs of axially aligned openings 30*a*, 20*b* and 30*b* and 22*b*, with the rearwardly projecting ends of the screws being engaged by nuts or fastening means 37 as shown in FIG. 4.

Figure 6:
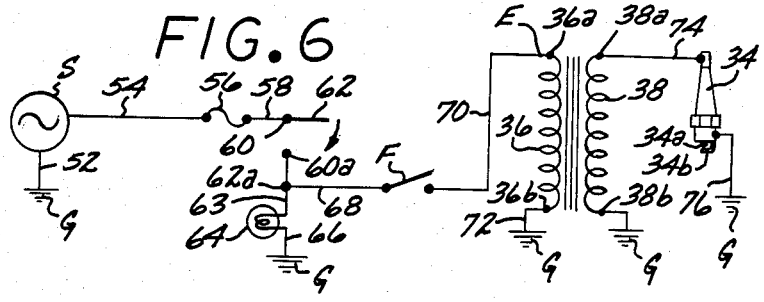
FIG. 6 is a diagrammatic view of the electric circuit used in the invention.

A high tension coil E is provided which as shown in FIGS. 3 and 4 is situated within the confines of the housing D and held in a fixed position relative thereto by a support 40 that is secured to the back wall 18 by a screw 41 or other conventional fastening means. The high tension coil E as shown in FIG. 6 includes a primary 36 that has terminals 36*a* and 36*b*, and a secondary winding 38 that has terminals 38*a* and 38*b*.

A bracket 42 is provided and situated on the upper portion of the forward wall 30, which bracket 42 is of an elongate shape and may be formed from a piece of stiff heavy wire. Bracket 42 includes oppositely disposed first and second arms 42*a* and 42*b* that extend outwardly from the forward wall 30. The first arm 42*a* terminates in an S shaped portion of 42*b* as may be seen in FIG. 7. The upper screw 35 as best seen in FIGS. 1 and 4 supports a clip 44 that engages the center portion of the portion of the bracket 42 and maintains it in a fixed position relative to the housing D. An elongate helical spring 46 is provided that has a straight end portion 46*a* as may best be seen in FIG. 7, which end portion has a loop 46*b* formed therein that pivotally engages the S shaped portion 42*b*, with the end portion 46*a* terminating in an eye 46*c*. The opposite end of the helical spring 46 is secured to the second arm 42*b* of bracket 42 by conventional means such as a loop or the like.

An electrical switch F is provided that has an elongate spring loaded actuator 48 projecting outwardly therefrom, which actuator when not pivoted from a first position maintains the switch F is an open position. The actuator 48 on the outer end thereof develops into a tightly wound helical spring 48*a*.

Figure 7:
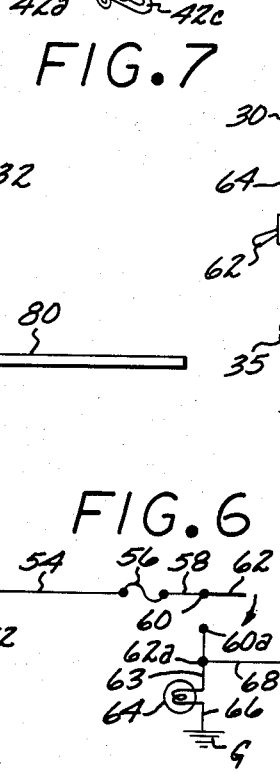
FIG. 7 is a fragmentary perspective view of the components used in moving a normally open electrical switch to the closed position when the welders torch is brought in contact with a tensioned helical spring situated forwardly in the invention and supported on a bracket.

The electrical switch F as shown in FIG. 3 is situated within the interior of the housing D, and is secured to the rear wall 18, with the actuator 48 projecting outwardly through a slot 32*a* formed in one of the side walls 32. The electrical switch F is secured to the rear wall 18 by conventional means (not shown). Cord 50 has one end thereof formed into a knot 50*a* as shown in FIG. 7, which knot engages the eye 46*c*. The cord 50 extends rearwardly to the helical spring 48*a* and is frictionally and adjustably gripped between two adjacent turns thereof. The cord 50 is adjusted so that there is no slack therein.

When the helical spring 46 is pressure contacted transversely in any direction, the end portion 46*a* will tend to pivot relative to the S shaped portion 42*c* of bracket 42, and in so doing tension the line or cord 50 to pivot the spring loaded actuator 48 from a first position to a second position and in so doing close the electrical switch F so long as tension is maintained on the cord 50. Such transverse pressure contact will be effected when the tip 16 of the welding torch B is brought into pressure contact with the spring 46.

A source of alternating current S, such as the domestic source of electric power, has one terminal thereof connected by a conductor 52 to ground G, while the other terminal by an electrical conductor 54 extends to a fuse 56, which fuse by an electrical conductor 58 is connected to an electrical switch 60 that is manually placed in a closed position by moving a handle 62 from a first to a second position. When handle 62 is in the closed position, electric current flows from a terminal 60*a* of the switch through an electrical conductor 63 to one terminal of a signal light 64, and the other terminal of the signal light being connected by an electrical conductor 66 to ground G. A junction point 62*a* in the electrical conductor 62 has an electrical conductor 68 extending therefrom to the electrical switch F, with the switch F when in the closed position allowing electrical current to flow through a conductor 70 to a first terminal 36*a* of the primary 36, and current flowing from the second terminal 36*b* to the ground G through an electrical conductor 72. The secondary 38 has a first terminal 38*a* thereon connected by an electrical conductor 74 to one terminal of the spark plug 34 that is in communication with the point 34*a*, and the second point 34*b* of the spark plug being in electrical communication with ground G through an electrical conductor 76.

When the light 64 is illuminated it indicates to a user of the invention A that it is operative.

The housing D is illustrated as being mounted on a flat elongate base 80 by screws 82, with the base of sufficient length to have the valve C mounted thereon if desired.

The use and operation of the invention is extremely simple. The handle 62 of switch 60 is moved to a position to close the switch, and the signal light being illuminated to indicate the invention is operative. The torch B is now picked up, with the valve assembly C now allowing oxygen and acetylene to flow to the torch. A control 84 on the torch is manually moved to a position where an oxygen-acetylene mixture discharges from the tip 16. The torch B is now moved for the tip 16 to pressure contact the spring 46, which results in pivotal movement of the end portion 46*a* and tensioning of the cord 50. This tensioning of cord 50 results in actuator 48 moving from a first to a second position to complete the electric circuit shown in FIG. 6. Completion of the electric circuit results in a spark being developed between the points 34*a* and 34*b* of spark plug 34, and the oxygen-acetylene mixture flowing from the tip 16 being ignited as a result thereof. Upon the lighted torch B being removed from pressure contact with the helical spring 46 that is tensioned, the actuator 48 automatically returns to the first position and the electrical circuit to high tension coil E is broken. The length of the cord 50 between eye 46*c* and the helical spring portion 48*a* may be adjusted to length due to the cord being frictionally gripped between adjacent turns of the spring. The cord 50 should be so adjusted so that it is taut, but not so taut as to inadvertently move the actuator 48 from the first to the second position when the invention A is subjected to vibration.

The use and operation of the invention has been described previously in detail and need not be repeated.

What is claimed is:

1. In combination with a source of alternating electric power a device for igniting a mixture of oxygen and acetylene flowing from a tip of a welders torch, said device including:

a. a vertically disposed housing that includes an upper end that has a plurality of spaced openings therein;

b. an electrical circuit that may be connected to said source of electrical power, said electrical circuit including first and second portions, said first portion incuding an electrically operated signal light and first electrical switch that is manually operated, said second portion including a high tension coil, a spark plug adjacent said upper end and a second electrical switch that includes a spring loaded actuator that when moved from a first to a second position closes said second electrical switch for said high tension coil to generate a spark at said spark plug, said first electrical switch and signal light mounted on said housing, and said signal light when illuminated indicating that said device is in an operating condition;

c. a bracket supported from said housing adjacent said top, said bracket including first and second spaced arms;

d. a tensioned helical spring that has a first elongate substantially straight end portion in which a loop is defined and a second end, said second end secured to said second arm and said loop pivotally engaging said first arm; and e. a cord that extends from the extremity of said straight end portion to said actuator, said helical spring when pressure contacted by said tip when the latter is disposed to discharge said oxygen-acetylene mixture onto said top flexing transversely and said straight end portion pivoting to tension said cord to move said actuator from said first to said second position to complete said second portion of said electrical circuit for said high tension coil to generate a spark at said spark plug to ignite said oxygen-acetylene mixture, with said actuator automatically moving to said first position when said tip is removed from contact with said helical spring.

* * * * *